US009786982B2

(12) United States Patent
Lee et al.

(10) Patent No.: US 9,786,982 B2
(45) Date of Patent: Oct. 10, 2017

(54) ELECTRONIC DEVICE

(71) Applicant: Samsung Electronics Co., Ltd., Suwon-si (KR)

(72) Inventors: Jung-Yub Lee, Yongin-si (KR); Young-Ju Lee, Seoul (KR); Jun-Sig Kum, Yongin-si (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 30 days.

(21) Appl. No.: 14/855,032

(22) Filed: Sep. 15, 2015

(65) Prior Publication Data

US 2016/0111773 A1 Apr. 21, 2016

(30) Foreign Application Priority Data

Sep. 15, 2014 (KR) ..... 10-2014-0122155

(51) Int. Cl.

| | |
|---|---|
| ***H01Q 1/27*** | (2006.01) |
| ***H01Q 1/24*** | (2006.01) |
| ***G04R 60/10*** | (2013.01) |
| ***G04R 60/04*** | (2013.01) |
| ***G04G 21/04*** | (2013.01) |
| ***H01Q 9/42*** | (2006.01) |
| ***G04R 60/12*** | (2013.01) |

(52) U.S. Cl.

CPC ..... *H01Q 1/273* (2013.01); *G04G 21/04* (2013.01); *G04R 60/04* (2013.01); *G04R 60/10* (2013.01); *G04R 60/12* (2013.01); *H01Q 1/243* (2013.01); *H01Q 9/42* (2013.01)

(58) Field of Classification Search

CPC ..... H01Q 1/273; H01Q 1/243; H01Q 9/42
See application file for complete search history.

(56) References Cited

U.S. PATENT DOCUMENTS

| | | | |
|---|---|---|---|
| 5,007,105 | A | 4/1991 | Kudoh |
| 5,159,713 | A | 10/1992 | Gaskill |
| 5,189,431 | A | 2/1993 | Marinelli |
| 6,350,055 | B1 | 2/2002 | Barras |
| 6,366,250 | B1 | 4/2002 | McConnell |
| 8,698,680 | B2 | 4/2014 | Gutschenritter et al. |
| 2015/0311960 | A1* | 10/2015 | Samardzija ..... G06F 1/163 455/90.3 |

FOREIGN PATENT DOCUMENTS

| | | |
|---|---|---|
| EP | 0308935 | 3/1989 |

OTHER PUBLICATIONS

Communication with European Search Report dated Mar. 9, 2016 corresponding to European Patent Application No. EP 15185173.

* cited by examiner

*Primary Examiner* — Hoang Nguyen
(74) *Attorney, Agent, or Firm* — McAndrews, Held & Malloy, Ltd.

(57) ABSTRACT

Provided is an electronic device which includes a body portion including a first radiator and a wearing portion including at least one second radiators, in which the second radiators form capacitive coupling with the first radiator or a ground portion provided in the body portion, thereby providing stable operation characteristics of the first radiator. The electronic device may be implemented variously according to an embodiment.

19 Claims, 4 Drawing Sheets

ELECTRONIC DEVICE

RELATED APPLICATION(S)

This application claims priority under 35 U.S.C. §119(a) to Korean Patent Application Serial No. 10-2014-0122155, which was filed in the Korean Intellectual Property Office on Sep. 15, 2014, the entire disclosure of which is hereby incorporated by reference.

TECHNICAL FIELD

Various embodiments of the present disclosure relate to an electronic device, for example, an electronic device capable of transmitting and receiving a wireless signal.

BACKGROUND

An electronic device refers to a device that performs a particular function according to a program or an embedded program, such as mobile communication terminal, a tablet Personal Computer (PC), a video/audio device, a desktop/laptop computer, a vehicle navigation system, or the like. For example, the electronic device may output stored information as audio or video. As the integration of an electronic device has increased and high-volume and ultra-high-speed wireless communication has come into common use, various functions are able to be mounted on a single mobile communication terminal. For example, various functions, such as a communication function as well as an entertainment function such as a game, a multimedia function for playback of music/video, communication and security functions for mobile banking, and a function for schedule management or an electronic wallet, have been integrated in a single electronic device.

With the recent trend of electronic devices toward miniaturization, electronic devices wearable on body parts such as a wrist or a head have come into use.

Depending on functions of an electronic device, the electronic device may need a plurality of antenna devices. For example, with a single electronic device, connection to communication networks having different frequency bands such as a general-purpose communication network, a wireless Local Area Network (LAN), Bluetooth, Near Field Communication (NFC), and so forth, may be possible.

However, in a small-size and light-weight electronic device, for example, a mobile communication terminal or a body-wearable electronic device, a lot of difficulties may exist in securing a space for installing an antenna device. Moreover, in the body-wearable electronic device, a difficulty may exist in securing a space for installing an antenna device, and even worse, when the electronic device is worn on the body, operation characteristics of the antenna device may be distorted due to an influence of the body.

The above information is presented as background information only to assist with an understanding of the present disclosure. No determination has been made, and no assertion is made, as to whether any of the above might be applicable as prior art with regard to the present disclosure.

BRIEF SUMMARY

The present disclosure has been made to at least partially solve, alleviate, or remove at least one of problems and/or disadvantages described above.

Accordingly, various embodiments of the present disclosure provide an electronic device having operation characteristics that are stable even in a small installation space.

Moreover, various embodiments of the present disclosure provide an electronic device having operation characteristics that are stable even when the electronic device is in close proximity to a body.

Other objects to be provided in the present disclosure may be understood by embodiments described below.

According to an aspect of the present disclosure, there is provided an electronic device including a first radiator included in a body portion of the electronic device and a conductive member disposed on an outer surface of the body portion, in which at least a part of the conductive member may be electrically coupled to the first radiator to form an antenna device that transmits and receives a wireless signal.

According to an aspect of the present disclosure, there is provided an electronic device including a first radiator disposed in a closed-loop shape on a front surface of a body portion of the electronic device and a feeder configured to provide an electrical signal through a point of the first radiator.

According to another aspect of the present disclosure, there is provided an electronic device including a body portion, a wearing portion for wearing the body portion on a body of a user, and a radiator included in the wearing portion to transmit and receive a wireless signal, in which the radiator is fed with electricity by forming capacitive coupling with the body portion.

According to another aspect of the present disclosure, there is provided an electronic device including a body portion comprising a first radiator and a wearing portion including at least one second radiators, in which the second radiators form capacitive coupling with the first radiator or a ground portion provided in the body portion.

Other aspects, advantages, and salient features of the disclosure will become apparent to those skilled in the art from the following detailed description, which, taken in conjunction with the annexed drawings, discloses an exemplary embodiment of the disclosure.

BRIEF DESCRIPTION OF SEVERAL VIEWS OF THE DRAWINGS

The above and other aspects, features and advantages of a certain embodiment of the present disclosure will be more apparent from the following detailed description taken in conjunction with the accompanying drawings, in which.

Throughout the drawings, like reference numerals will be understood to refer to like parts, components, and structures.

DETAILED DESCRIPTION

Figure 1:
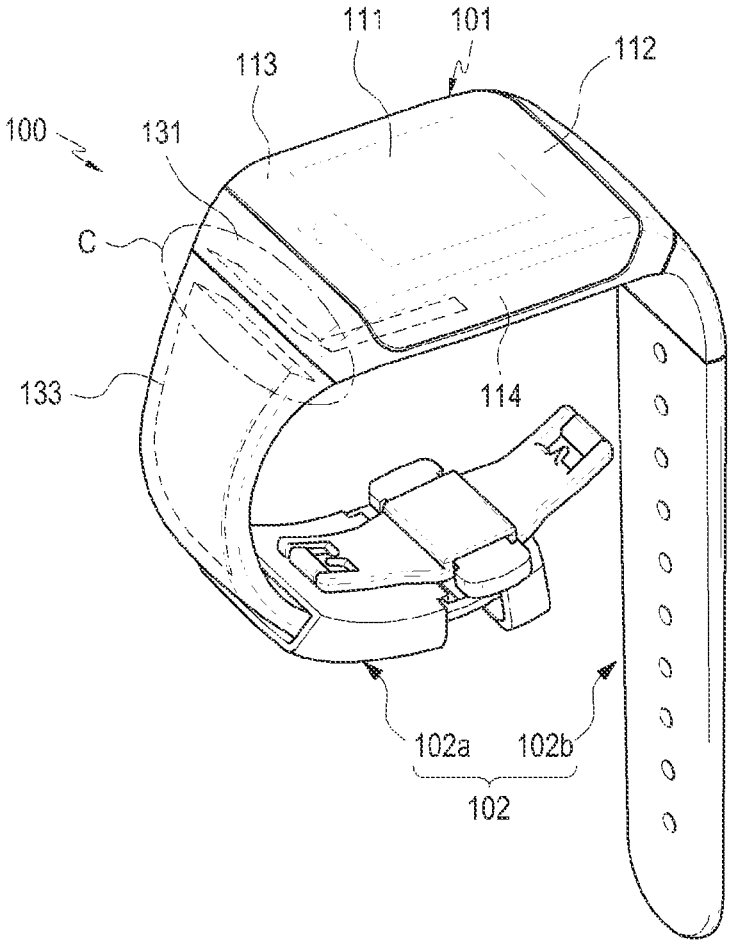
FIG. 1 is a perspective view of an electronic device according to various embodiments of the present disclosure.

Various embodiments of the present disclosure may be changed variously and may have a variety of embodiments, such that particular embodiments have been illustrated in the drawings and a related detailed description thereof will be provided below. However, this is not intended to limit the various embodiments to particular embodiments, and should be understood that all changes, equivalents, or substitutes included in the spirit and technical scope of the present disclosure are included in the scope of the present disclosure.

Although ordinal numbers such as "first", "second", and so forth will be used to describe various components of the present disclosure, those components are not limited by the terms. The terms are used only for distinguishing one component from another component. For example, a first component may be referred to as a second component and likewise, a second component may also be referred to as a first component, without departing from the teaching of the inventive concept. The term "and/or" used herein includes any and all combinations of one or more of the associated listed items.

Relative terms used based on illustration in the drawings, such as a "front side", a "rear side", a "top surface", a "bottom surface", and the like, may be replaced with ordinal numbers such as "first", "second", and the like. The order of the ordinal numbers such as "first", "second", and the like is a mentioned order or an arbitrarily set order, and may be changed as needed.

The terminology used herein is for the purpose of describing an embodiment only and is not intended to be limiting of an embodiment. As used herein, the singular forms are intended to include the plural forms as well, unless the context clearly indicates otherwise. It will be further understood that the terms "comprises" and/or "has" when used in this specification, specify the presence of a stated feature, number, step, operation, component, element, or a combination thereof but do not preclude the presence or addition of one or more other features, numbers, steps, operations, components, elements, or combinations thereof.

Unless defined otherwise, all terms used herein have the same meanings as generally understood by those having ordinary knowledge in the technical field to which the present disclosure pertains. Terms generally used and defined in dictionaries should be interpreted as having meanings consistent with meanings construed in the context of the related art, and should not be interpreted as having ideal or excessively formal meanings unless defined explicitly in this application.

In various embodiments of the present disclosure, an electronic device may be an arbitrary device having a touch panel and may be referred to as a terminal, a portable terminal, a mobile terminal, a communication terminal, a portable communication terminal, a portable mobile terminal, a display, or the like.

For example, the electronic device may be a smart phone, a cellular phone, a navigation device, a game console, a television (TV), a vehicle head unit, a laptop computer, a tablet computer, a Personal Media Player (PMP), a Personal Digital Assistant (PDA), or the like. The electronic device may be implemented with a pocket-size portable communication terminal having a wireless communication function. The electronic device may be a flexible device or a flexible display.

The electronic device may communicate with an external electronic device such as a server or may work by cooperating with the external electronic device. For example, the electronic device may transmit an image captured by a camera and/or position information detected by a sensor unit to the server over a network. The network may be, but not limited to, a mobile or cellular communication network, a Local Area Network (LAN), a Wireless Local Area Network (WLAN), a Wide Area Network (WAN), Internet, or a Small Area Network (SAN).

Figure 2:
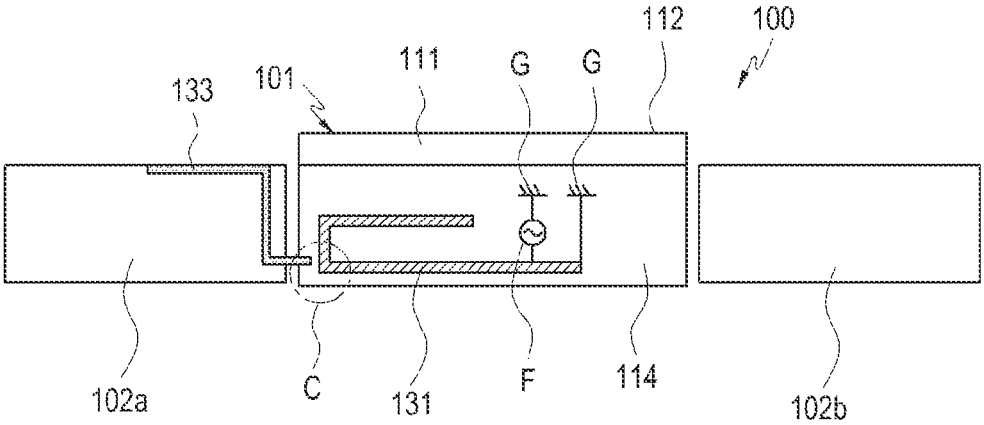
FIG. 2 is a diagram of an electronic device according to various embodiments of the present disclosure.

FIG. 1 is a perspective view of an electronic device 100 according to various embodiments of the present disclosure. FIG. 2 is a diagram of the electronic device 100 according to various embodiments of the present disclosure.

Referring to FIGS. 1 and 2, the electronic device 100 may include a body portion 101 and a wearing portion 102 that enables the body portion 101 to be wearable on a body of a user.

The body portion 101 may include various circuit devices such as an Application Processor (AP) (not shown), a communication circuit (not shown), a memory device (not shown), and so forth, and may include a display device 111 installed on a front surface 112 thereof. The body portion 101 may be formed of a synthetic resin material that is easy to mold, and at least a part of an outer surface 114 of the body portion 101 may be formed of a conductive member, for example, a metallic material. The body portion 101 may include, for example, a first radiator 131. The first radiator 131 is connected to a feeder ("F" of FIG. 2) in the body portion 101 to be fed with electricity, and is short-circuited from a ground portion ("G" of FIG. 2), thus implementing an Inverse-F Antenna (IFA) structure. However, the first radiator 131 is not limited to the IFA structure. For example, the first radiator 131 may be implemented with a monopole antenna, a loop antenna, a meanderline antenna, a microstrip antenna, a chip antenna, or the like. The first radiator 131 may transmit and receive a wireless signal in at least one frequency bands, such as a common-use communication network frequency band, a local area communication network frequency band (a wireless LAN or Bluetooth), a short-range communication frequency band (NFC or wireless charging), and so forth, according to its design items.

The wearing portion 102 enables the body portion 101 to be worn on the user's body, and may include wearing members 102*a* and 102*b* that extend from the body portion 101. The wearing members 102*a* and 102*b* may be implemented as a band or a wristwatch chain, and may be connected to each other to form a closed-curve shape surrounding the body. The wearing portion 102 may include a second radiator 133 included in at least one of the wearing members 102*a* and 102*b*. The second radiator 133 may be fed with electricity by forming capacitive coupling ("C" of FIG. 2) with the first radiator 131 or the ground portion provided in the body portion 101. By forming capacitive coupling with the first radiator 131 or the ground portion provided in the body portion 101, the second radiator 133 may improve operation characteristics of the first radiator 131. The first radiator 131 may be used as a main radiator that is fed with electricity in the body portion 101 and transmits and receives a wireless signal in a designed frequency band. The second radiator 133 forms capacitive coupling with the first radiator 131 or the ground portion provided in the body portion 101, thus forming radiation performance of the first radiator 131. For example, the first radiator 131 may operate independently of the second radiator 133, and when the first radiator 131 forms capacitive coupling with the second radiator 133, radiation characteristics of the first radiator 131 may be improved.

When the second radiator 133 forms capacitive coupling with the first radiator 131, the second radiator 133 may form capacitive coupling with a portion of the first radiator 131, which is farthest in a straight line from a point where the feeder is connected to the first radiator 131. If the first radiator 131 is implemented with a monopole antenna structure or an IFA structure, an electric field and/or an electromagnetic field may be concentrated at the point that is farthest in a straight line from the feeder, and at that point (the electric-field-concentrated point), effective capacitive coupling between the first radiator 131 and 133 may be formed.

A measurement result of an antenna gain of a conventional electronic device (e.g., an electronic device having a radiator only in a body portion) having a radiator operating in a frequency band of 2402-2480 MHz in a body portion and a measurement result of an antenna gain of the electronic device 100 are compared in Table 1. In Table 1, the antenna gains are measured before a user wears the respective conventional electronic device and electronic device 100, and after the user wears the same, respectively.

TABLE 1

| Wearing State | Conventional Electronic Device (Only First Radiator) | Electronic Device 100 (First Radiator + Second Radiator) | Antenna Gain Improvement |
|---|---|---|---|
| Before Wearing | −10.3 dB | −5.92 dB | +4.4 dB |
| After Wearing | −14.7 dB | −11.2 dB | +3.5 dB |

As can be seen from Table 1, disposing the second radiator 133 in the wearing portion 102 to form the capacitive coupling (C) with the first radiator provided in the body portion 101 (or the ground portion (G) provided in the body portion 101) improves an antenna gain of the electronic device 100.

Figure 3:
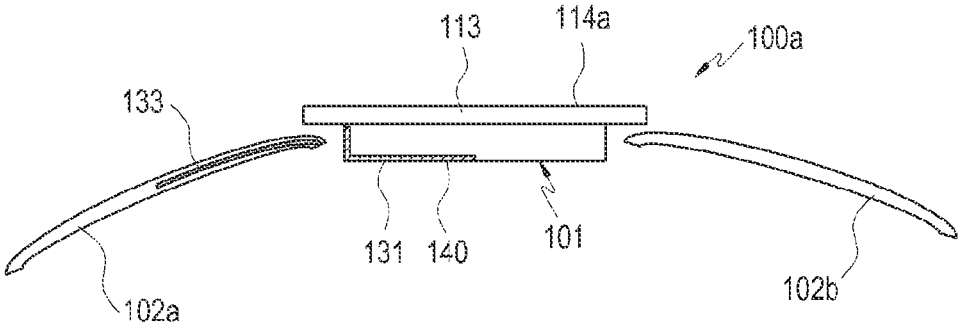
FIG. 3 is a diagram of an electronic device according to one of various embodiments of the present disclosure.
Figure 4:
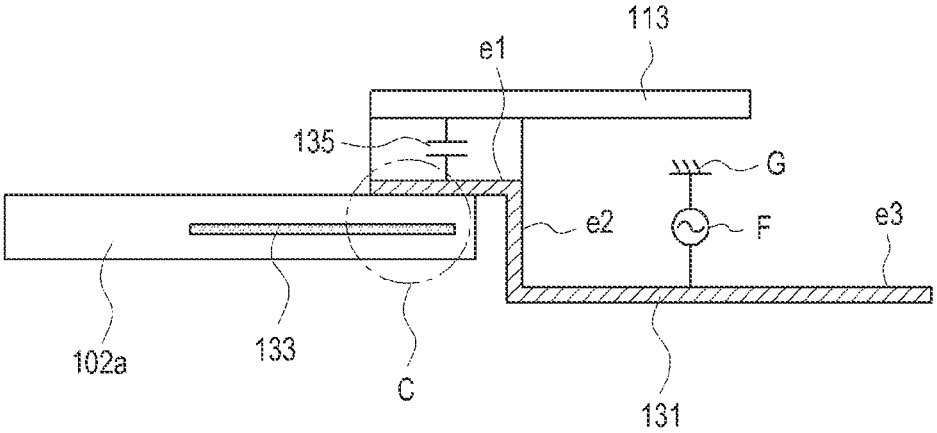
FIG. 4 illustrates an electrical structure of an electronic device according to one of various embodiments of the present disclosure.
Figure 5:
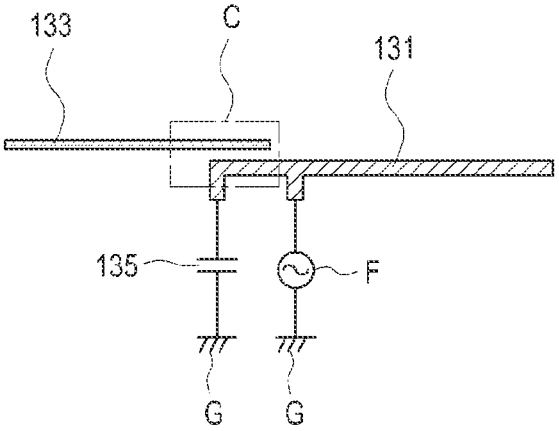
FIG. 5 is a circuit diagram for describing an antenna device of an electronic device according to one of various embodiments of the present disclosure.

FIG. 3 is a block diagram of an electronic device 100*a* according to one of various embodiments of the present disclosure. FIG. 4 is a diagram of an electrical structure of the electronic device 100*a* according to one of various embodiments of the present disclosure. FIG. 5 is a circuit diagram for describing an antenna device of the electronic device 100*a* according to one of various embodiments of the present disclosure.

Referring to FIGS. 3 through 6, when a conductive member 113 is disposed on an outer surface 114*a* of the electronic device 100*a*, the conductive member 113 may include a ground member (G of FIG. 4) for providing a reference potential to circuit devices included in the body portion 101. When the second radiator 133 included in at least one of the wearing members 102*a* and 102*b* forms capacitive coupling C with the first radiator 131 included in the body portion 101, the conductive member 113 may be an obstacle. For example, if the electronic device 100*a* has a miniaturized structure like a wearable electronic device, the first radiator 131 and the second radiator 133 may be located adjacent to the conductive member 113 such that an electric field and/or an electromagnetic field concentration effect may be degraded unlike in the previous embodiment.

According to various embodiments, the conductive member 113 provides grounding to the body portion 101 and the ground portion (G of FIG. 4) from which the first radiator 131 is short-circuited is set as the conductive member 113, thus forming stable capacitive coupling C between the first radiator 131 and the second radiator 133. For example, the conductive member 113 may be short-circuited together with the first radiator 131 to form a part of an antenna device for providing wireless transmission and reception functions of the electronic device 100*a*. The first radiator 131 may be short-circuited to the conductive member 113 through capacitive coupling C with the conductive member 113. To more stably short-circuit the first radiator 131 to the conductive member 113, the electronic device 100*a* may further include a capacitive element 135 that connects the first radiator 131 to the conductive member 113. The electronic device 100*a* may form an antenna device for transmitting and receiving a wireless signal in a frequency band designed through electrical coupling between the conductive member 113 and the first radiator 131, even if the second radiator 133 does not form capacitive coupling with the conductive member 113 or the first radiator 131.

Capacitive coupling C, 135 formed between the conductive member 113 and the first radiator 131 and between the second radiator 133 and the first radiator 131 may be formed at an end of the first radiator 131. For example, in a first element e1 of the first radiator 131 in which capacitive coupling C between the second radiator 133 and the first radiator 131 is formed, the first radiator 131 may be short-circuited to the conductive member 113. The first element e1 may be disposed in parallel with the second radiator 133 between the second radiator 133 and the conductive member 113. Moreover, the first radiator 131 may include a second element e2 extending perpendicularly from the first element e1 and a third element e3 disposed in parallel with the first element e1, extending perpendicularly from the second element e2. As mentioned above, the first radiator 131 may be short-circuited by forming capacitive coupling with the conductive member 113, and may connect and short-circuit the first radiator 131 to the conductive member 113 through the capacitive element 135.

Figure 6:
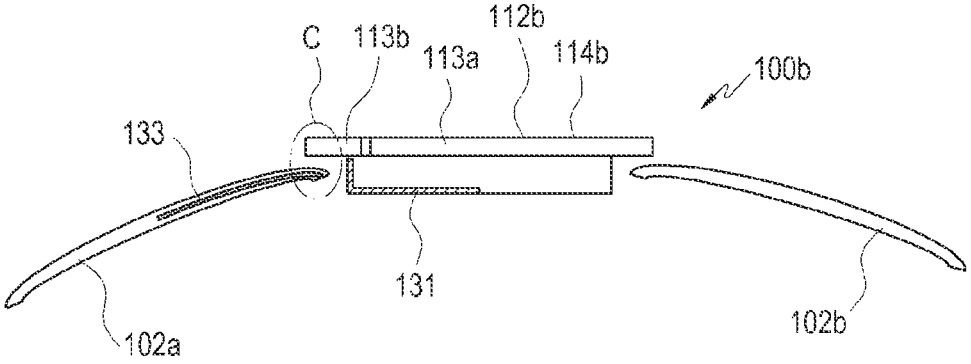
FIG. 6 is a diagram of an electronic device according to another one of various embodiments of the present disclosure.
Figure 7:
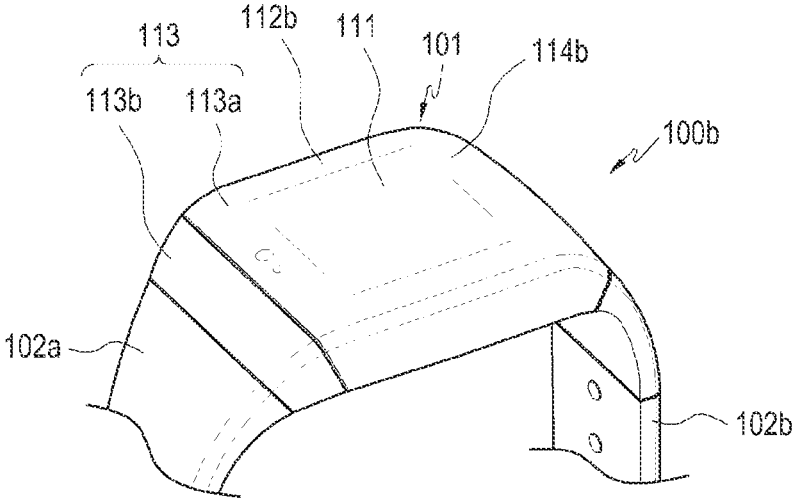
FIG. 7 is a perspective view illustrating a part of an electronic device according to another one of various embodiments of the present disclosure.

FIG. 6 is a diagram of an electronic device 100*b* according to another one of various embodiments of the present disclosure. FIG. 7 is a perspective view of a part of the electronic device 100*b* according to another one of various embodiments of the present disclosure.

Referring to FIGS. 6 and 7, if the conductive member 113 (including conductors 113*a* and 113*b*) is disposed on an outer surface 114*b* of the electronic device 100*b*, at least a part of the conductive member 113 is used as a part of the first radiator 131 or is used as a bridge for forming effective capacitive coupling C between the first radiator 131 and the second radiator 133. By using the conductive member 113 as a part of the radiator or a bridge, degradation of an electric-field concentration effect due to the conductive member 113 may be prevented.

The conductive member 113 may include at least a pair of conductors 113*a* and 113*b*. A first conductor 113*a* may be disposed to surround the circumference of the display device 111 on a front surface 112*b* of the body portion 101, making the exterior of the electronic device 100*b* elegant and reinforcing the structural strength of the body portion 101. The first conductor 113*a* may include a ground portion (not shown) for providing a reference potential for the body portion or circuit devices included in the body portion 101.

A second conductor 113*b*, which is a part of the conductive member 113, may be located at a side edge on the outer surface 114*b* (e.g., the front surface 112*b*) of the body portion 101. The second conductor 113*b* may be electrically connected to the first radiator 131 included in the body portion 101.

In a detailed embodiment, the first radiator 131 and the second conductor 113*b* are described as separate components, but the second conductor 113*b* may be directly connected with the first radiator 131 to be implemented as a part of the first radiator 131. If the second conductor 113*b* is disposed at a point that is farthest in a straight line from a feeder (e.g., F of FIG. 2, FIG. 4, and/or FIG. 5) of the first radiator 131, an electric field and/or an electromagnetic field may be concentrated in the second conductor 113*b* when electricity is fed to the first radiator 131. When capacitive coupling C is formed between the second radiator 133 included in the wearing portion and the first radiator 131, the capacitive coupling C passes through the second conductor 113*b*, thus forming effective capacitive coupling C. For example, by disposing a part of the second radiator 133 in adjacent to the second conductor 113*b*, the second radiator 133 may form effective capacitive coupling C with the first radiator 131.

Figure 8:
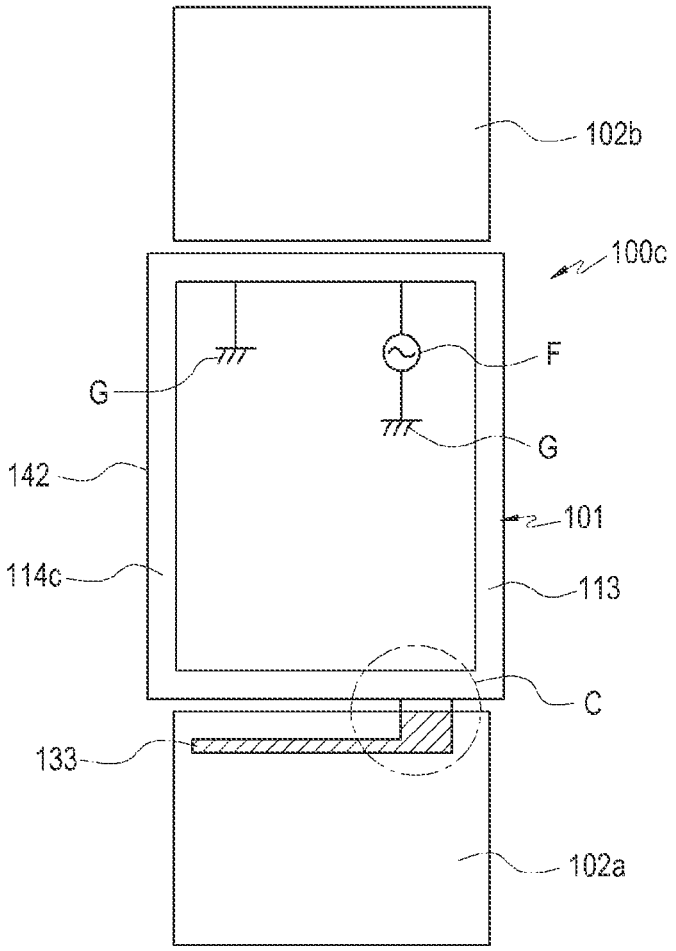
FIG. 8 is a diagram of an electronic device according to another one of various embodiments of the present disclosure.

FIG. 8 is a diagram of an electronic device 100*c* according to yet another one of various embodiments of the present disclosure.

Figure 9:
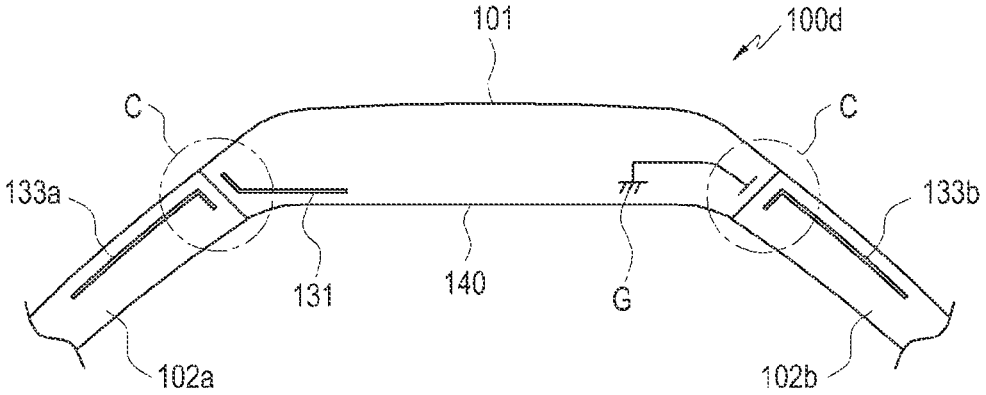
FIG. 9 is a diagram of an electronic device according to another one of various embodiments of the present disclosure.

Referring to FIG. 8, when the conductive member 113 is disposed on an outer surface 114*c* of the electronic device 100*c*, the conductive member 113 may be used as a radiator of an antenna device. When the conductive member 113 is used as a radiator, the second radiator 133 included in the wearing portion 102 may form capacitive coupling C with the conductive member 113. The conductive member 113 is mounted on the outer surface on the front surface of the electronic device 100*c*, for example, the body portion 101, and a point of the conductive member 113 is connected to a feeder F and is provided with an electrical signal. Another point of the conductive member 113 may be short-circuited to a ground portion G. Herein, the 'ground portion' may be implemented with a conductive printed layer or pattern disposed on at least one of an inner surface (wall) (not shown) of the body portion 101, a back surface 140 (as shown in FIG. 3, and FIG. 9) of the body portion 101, a side surface 142 of the circumference of the body portion 101, and circuit boards included in the body portion 101, and the ground portion may provide a reference potential to the first radiator 131, for example, the conductive member 113, or circuit devices included in the body portion 101. According to various embodiments, the first radiator 131 included in the body portion 101 in the previous embodiment may be implemented as the ground portion G that provides a reference potential in the current embodiment. If the conductive member 113, for example, the first radiator is provided in a closed-loop shape (e.g., a closed-curve or polygonal shape), and if the feeder F and the group portion G are connected to two different points of the conductive member 113, an electric field and/or an electromagnetic field may be concentrated on the conductive member 113 at a point that is farthest in a straight line from a point short-circuited to the ground portion G. When the second radiator 133 included in the wearing portion 102 forms capacitive coupling C with the first radiator 131, for example, the conductive member 113, a part of the second radiator 133 may be disposed in adjacent to the point at which the electric field and/or the electromagnetic field is concentrated (e.g., the point on the conductive member 113, which is farthest in a straight line from the point short-circuited to the ground portion). However, since a position at which the body portion 101 and the wearing portion are coupled is limited to a predetermined range (hereinafter, referred to as a 'connecting range'), the first radiator 131 may form capacitive coupling C with the second radiator 133 at a point that is farthest in a straight line from the point short-circuited to the ground portion G within the connection range.

As such, when the conductive member 113 is disposed on the exterior of the body portion 101, to form capacitive coupling between the first radiator 131 included in the body portion 101 and the second radiator 133 included in the wearing portion 102, the conductive member 113 may provide grounding to the first radiator 131 or the entire conductive member 113 or a part thereof may be used as the radiator 131. For example, the conductive member 113 disposed on the exterior of the body portion 101 may form a part of the antenna device to transmit and receive a wireless signal. Thus, even when the conductive member 113 is disposed on the exterior of the body portion 101, effective capacitive coupling may be formed between the first radiator 131 included in the body portion 101 and the second radiator 133 included in the wearing portion 102.

Table 2 shows comparison between measurement results of an antenna gain of a conventional electronic device (e.g., an electronic device having a conductive member disposed on an exterior thereof and a radiator in a body portion) and an antenna gain of the electronic device 100 when the radiator operating in a frequency band of 880-960 MHz is included in the body portion and the user wears the electronic device 100. In Table 2, in an embodiment of the present disclosure, measurement has been made with respect to an electronic device in which a conductive member disposed in a body portion provides grounding to a first radiator.

TABLE 2

| Wearing State | Conventional Electronic Device (Only First Radiator) | Electronic Device 100 (First Radiator + Second Radiator) | Antenna Gain Improvement |
|---|---|---|---|
| After Wearing | −14.4 dB | −10.9 dB | +3.5 dB |

FIG. 9 is a diagram of an electronic device 100*d* according to another one of various embodiments of the present disclosure.

Referring to FIG. 9, the wearing portion includes a pair of wearing members 102*a* and 102*b* which include second radiators 133*a* and 133*b*, respectively. One of the second radiators 133*a* and 133*b* may form capacitive coupling C with the first radiator 131 included in the body portion 101, and the other of the second radiators 133*a* and 133*b* may form another capacitive coupling C with the ground portion G provided in the body portion 101. As mentioned above, the first radiator 131 may transmit and receive a wireless signal in a frequency band that is designed irrespectively of the second radiator 133, and the second radiators 133*a* and 133*b* may form capacitive coupling C with the first radiator 131 or the ground portion G to improve radiation performance of the first radiator 131. The second radiators 133*a* and 133*b* may form capacitive coupling C with the first radiator 131 or the ground portion G according to each of the previous embodiments or a combination of the previous embodiments.

Table 3 shows comparison between improvements of an antenna gain of a conventional electronic device (e.g., an electronic device having a radiator in a body portion) and an antenna gain of the electronic device 100*d* when the radiator operating in a frequency of 824-894 MHz is included in the body portion and the user wears the electronic device 100*d*. The antenna gain of the electronic device 100*d* has been measured for a state when one of the second radiators 133*a* and 133*b* forms capacitive coupling C with the first radiator 131 or the ground portion G and for a state when both the second radiators 133*a* and 133*b* form capacitive coupling C with the first radiator 131 and the ground portion G at the same time.

TABLE 3

| Wearing State | Electronic Device 100d (First Radiator + Second Radiator) | Electronic Device 100d (Ground Portion + Second Radiator) | Electronic Device 100d (First Radiator + Second Radiator) (Ground Portion + Second Radiator) |
|---|---|---|---|
| After Wearing | +3.39 dB | +2.66 dB | +4.65 dB |

A capacitive coupling structure between a first radiator and a second radiator may vary with a resonance frequency band of the first radiator, disposition or non-disposition of a conductive member, a shape of an electronic device (or a body portion), and the like. Moreover, a measurement result of an antenna gain may differ from measurement results of the foregoing embodiments according to the resonance frequency band of the first radiator, disposition or non-disposition of the conductive member, the shape of the electronic device (or the body portion), and the capacitive coupling structure between the first radiator and the second radiator.

In an electronic device according to various embodiments of the present disclosure, the first radiator included in the body portion may transmit and receive a wireless signal in a frequency band designed therein and may form capacitive coupling with the second radiator provided in the wearing portion. By forming capacitive coupling between the first radiator and the second radiator, the radiation performance of the first radiator, for example, the antenna device may be improved. Parts of the first radiator and the second radiator are disposed in adjacent to each other to form capacitive coupling, and when the conductive member is disposed nearby, the conductive member may be configured as a part of the antenna device (e.g., may provide grounding to the first radiator or may be directly connected to the first radiator electrically). Moreover, the conductive member disposed on the exterior of the electronic device (e.g., the body portion) may be implemented as the radiator. By disposing a part of the second radiator in adjacent to a point where an electric field and/or an electromagnetic field is concentrated on the first radiator when electricity is fed to the first radiator, effective capacitive coupling may be formed between the first radiator and the second radiator.

As described above, an electronic device according to various embodiments of the present disclosure include a first radiator included in a body portion of the electronic device and a conductive member disposed on an outer surface of the body portion, in which at least a part of the conductive member may be electrically coupled to the first radiator to form an antenna device that transmits and receives a wireless signal.

According to various embodiments of the present disclosure, the conductive member may form capacitive coupling with the first radiator.

According to various embodiments of the present disclosure, the electronic device may further include a wearing portion connected to the body portion to wear the body portion on a body of a user and a second radiator included in the wearing portion, in which the second radiator forms capacitive coupling with the first radiator.

According to various embodiments of the present disclosure, the first radiator may include a first element disposed overlappingly between the conductive member and the second radiator to form capacitive coupling with the conductive member and the second radiator, a second element extending perpendicularly from the first element, and a third element extending perpendicularly from the second element and being disposed in parallel with the first element, in which the conductive member comprises a ground member for providing a reference potential.

According to various embodiments of the present disclosure, the electronic device may further include a capacitive element configured to connect the conductive member with the first radiator.

According to various embodiments of the present disclosure, the conductive member may include a first conductor disposed on a front surface of the body portion and a second conductor disposed in adjacent to the first conductor on a front surface of the body portion.

According to various embodiments of the present disclosure, the second conductor may be electrically connected with the first radiator.

According to various embodiments of the present disclosure, the electronic device may further include a wearing portion connected to the body portion to wear the body portion on a body of a user and a second radiator included in the wearing portion, in which the second radiator forms capacitive coupling with the second conductor.

According to various embodiments of the present disclosure, the first conductor may provide grounding to the body portion.

According to various embodiments of the present disclosure, the electronic device may further include a first radiator disposed in a closed-loop shape on a front surface of the body portion of the electronic device and a feeder configured to provide an electrical signal through a point of the first radiator.

According to various embodiments of the present disclosure, another point of the first radiator may be connected to the feeder of the body portion.

According to various embodiments of the present disclosure, the electronic device may further include a wearing portion connected to the body portion to wear the body portion to a body of a user and a second radiator included in the wearing portion, in which at a point that is farthest in a straight line from the point of the first radiator connected to the ground portion, the second radiator forms capacitive coupling with another point of the first radiator.

According to various embodiments of the present disclosure, an electronic device may include a body portion, a wearing portion for wearing the body portion on a body of a user, and a radiator included in the wearing portion to transmit and receive a wireless signal, in which the radiator is fed with electricity by forming capacitive coupling with the body portion.

According to various embodiments of the present disclosure, the electronic device may further include a main radiator included in the body portion, in which the radiator forms capacitive coupling with the main radiator.

According to various embodiments of the present disclosure, electricity may be fed to an end portion of the main radiator and the radiator may form capacitive coupling with the main radiator at a point that is farthest in a straight line from a feeding point of the main radiator.

According to various embodiments of the present disclosure, the electronic device may further include a main radiator included in the body portion and a conductive member disposed on an outer surface of the body portion to provide grounding to the main radiator, in which the main radiator forms capacitive coupling with the radiator and the conductive member.

According to various embodiments of the present disclosure, the radiator and the conductive member may form capacitive coupling with an end portion of the main radiator, respectively.

According to various embodiments of the present disclosure, the electronic device may further include a main radiator included in the body portion and a conductive member disposed on an outer surface of the body portion and electrically connected to the main radiator, in which the radiator forms capacitive coupling with the conductive member.

According to various embodiments of the present disclosure, the electronic device may further include a conductive member in a closed-loop shape, which is mounted on an outer surface of the body portion, in which a part of the conductive member is connected to a ground portion of the body portion and another part of the conductive member is connected to a feeder of the body portion to form a main radiator, and the radiator forms capacitive coupling with further another part of the conductive member at a point that is farthest in a straight line from the part of the conductive member connected to the ground portion.

According to various embodiments of the present disclosure, an electronic device may include a body portion comprising a first radiator and a wearing portion including at least one second radiators, in which the second radiators form capacitive coupling with the first radiator or a ground portion provided in the body portion.

According to various embodiments of the present disclosure, the wearing portion may include a pair of wearing bands extending from both sides of the body portion, and the second radiators may be included in the wearing bands, respectively.

According to various embodiments of the present disclosure, one of the second radiators may form capacitive coupling with the first radiator and the other of the second radiators may form capacitive coupling with the ground portion.

According to various embodiments of the present disclosure, electricity may be fed to an end portion of the first radiator and the second radiator may form capacitive coupling with the first radiator at a point that is farthest in a straight line from a feeding point of the first radiator.

According to various embodiments of the present disclosure, the electronic device may further include a conductive member disposed on an outer surface of the body portion, in which the conductive member provides grounding to the first radiator.

According to various embodiments of the present disclosure, the conductive member and the second radiator may form capacitive coupling with the end portion of the first radiator, respectively.

According to various embodiments of the present disclosure, the electronic device may further include a first conductor disposed on an outer surface of body portion to provide grounding to the body portion and a second conductor disposed in adjacent to the first conductor on the outer surface of the body portion, in which the second conductor is electrically connected to the first radiator and the second radiator forms capacitive coupling with the second conductor.

According to various embodiments of the present disclosure, the first radiator may be a conductive member in a closed-loop shape disposed on the outer surface of the body portion, and the second radiator may form capacitive coupling with the conductive member.

According to various embodiments of the present disclosure, a part of the conductive member may be connected to the ground portion of the body portion and another part of the conductive member is connected to a feeder of the body portion, and at a point that is farthest in a straight line from a part of the conductive member connected with the ground portion, the second radiator may form capacitive coupling with further another part of the conductive member.

As is apparent from the foregoing description, in the electronic device according to various embodiments of the present disclosure, the second radiator (or the auxiliary radiator) is disposed in the wearing portion that enables the body portion to be wearable on the user's body, thus being easy to install in the miniaturized electronic device such as a body-wearable electronic device. In addition, the second radiator disposed in the wearing portion forms capacitive coupling with the first radiator (or the main radiator) included in the body portion, guaranteeing the stable operation characteristics of the antenna device.

While the present disclosure has been particularly illustrated and described with reference to exemplary embodiments thereof, various modifications or changes can be made without departing from the scope of the present disclosure.

The invention claimed is:

1. An electronic device comprising:

a first radiator included in a body portion of the electronic device;

a wearing portion connected to the body portion to wear the body portion on a body of a user; and a second radiator included in the wearing portion and configured to form capacitive coupling with the first radiator; and a conductive member disposed on an outer surface of the body portion, wherein at least a part of the conductive member may be electrically coupled to the first radiator to form an antenna device that transmits and receives a wireless signal.

2. The electronic device of claim 1, wherein the conductive member forms capacitive coupling with the first radiator.

3. The electronic device of claim 1, wherein the first radiator comprises:

a first element disposed overlappingly between the conductive member and the second radiator to form capacitive coupling with the conductive member and the second radiator;

a second element extending perpendicularly from the first element; and a third element extending perpendicularly from the second element and being disposed in parallel with the first element, wherein the conductive member comprises a ground member for providing a reference potential.

4. The electronic device of claim 2, further comprising a capacitive element configured to connect the conductive member with the first radiator.

5. The electronic device of claim 1, wherein the conductive member comprises:

a first conductor disposed on a front surface of the body portion; and a second conductor disposed in adjacent to the first conductor on a front surface of the body portion.

6. The electronic device of claim 5, wherein the second conductor is electrically connected with the first radiator.

7. The electronic device of claim 6, further comprising:

a wearing portion connected to the body portion to wear the body portion on a body of a user; and a second radiator included in the wearing portion, wherein the second radiator forms capacitive coupling with the second conductor.

8. The electronic device of claim 5, wherein the first conductor provides grounding to the body portion.

9. An electronic device comprising:

a first radiator disposed in a closed-loop shape on a front surface of a body portion of the electronic device;

a feeder configured to provide an electrical signal through a point of the first radiator;

a wearing portion connected to the body portion to wear the body portion on a body of a user; and a second radiator included in the wearing portion, wherein a point of the first radiator is connected to the feeder of the body portion, and wherein at a point that is farthest in a straight line from the point of the first radiator connected to the ground portion, the second radiator forms capacitive coupling with another point of the first radiator.

10. A wearing portion for an electronic device with a body portion comprising:

a radiator included in the wearing portion to transmit and receive a wireless signal, wherein the wearing portion is configured to wear the body portion on a body of a user, and the radiator is fed with electricity by forming capacitive coupling with the body portion, wherein the radiator forms capacitive coupling with a main radiator included in the body portion, and wherein electricity is fed to an end portion of the main radiator and the radiator forms capacitive coupling with the main radiator at a point that is farthest in a straight line from a feeding point of the main radiator.

11. A wearing portion for an electronic device with a body portion comprising:

a radiator included in the wearing portion to transmit and receive a wireless signal, wherein the wearing portion is configured to wear the body portion on a body of a user, and the radiator is fed with electricity by forming capacitive coupling with the body portion, wherein the radiator forms capacitive coupling with a main radiator included in the body portion, and wherein the radiator forms capacitive coupling with a conductive member disposed on an outer surface of the body portion and electrically connected to the main radiator.

12. The wearing portion of claim 11, wherein the radiator forms capacitive coupling with a part of the conductive member at a point that is farthest in a straight line from another part of the conductive member connected to a ground portion of the body, while further another part of the conductive member is connected to a feeder of the body portion.

13. An electronic device comprising:

a body portion comprising a first radiator; and a wearing portion including at least one second radiators, wherein the second radiators form capacitive coupling with the first radiator or a ground portion provided in the body portion, wherein the wearing portion comprises a pair of wearing bands extending from both sides of the body portion, the second radiators are included in the wearing bands, respectively, and wherein one of the second radiators forms capacitive coupling with the first radiator and the other of the second radiators forms capacitive coupling with the ground portion.

14. An electronic device comprising:

a body portion comprising a first radiator; and a wearing portion including at least one second radiators, wherein the second radiators form capacitive coupling with the first radiator or a ground portion provided in the body portion, and wherein electricity is fed to an end portion of the first radiator and the second radiator forms capacitive coupling with the first radiator at a point that is farthest in a straight line from a feeding point of the first radiator.

15. An electronic device of comprising:

a body portion comprising a first radiator; and a wearing portion including at least one second radiators, and a conductive member disposed on an outer surface of the body portion, wherein the second radiators form capacitive coupling with the first radiator or a ground portion provided in the body portion, and wherein the conductive member provides grounding to the first radiator.

16. The electronic device of claim 15, wherein the conductive member and the second radiator form capacitive coupling with the end portion of the first radiator, respectively.

17. An electronic device of comprising:

a body portion comprising a first radiator; and a wearing portion including at least one second radiators, a first conductor disposed on an outer surface of body portion to provide grounding to the body portion; and a second conductor disposed in adjacent to the first conductor on the outer surface of the body portion, wherein the second radiators form capacitive coupling with the first radiator or a ground portion provided in the body portion, and wherein the second conductor is electrically connected to the first radiator and the second radiator forms capacitive coupling with the second conductor.

18. An electronic device of comprising:

a body portion comprising a first radiator; and a wearing portion including at least one second radiators, wherein the second radiators form capacitive coupling with the first radiator or a ground portion provided in the body portion, and wherein the first radiator is a conductive member in a closed-loop shape disposed on the outer surface of the body portion, and the second radiator forms capacitive coupling with the conductive member.

19. The electronic device of claim 18, wherein a part of the conductive member is connected to the ground portion of the body portion and another part of the conductive member is connected to a feeder of the body portion, and at a point that is farthest in a straight line from a part of the conductive member connected with the ground portion, the second radiator forms capacitive coupling with further another part of the conductive member.

* * * * *